US008826989B2

(12) United States Patent
Lyle

(10) Patent No.: US 8,826,989 B2
(45) Date of Patent: Sep. 9, 2014

(54) METHOD FOR CAPPING A WELL IN THE EVENT OF SUBSEA BLOWOUT PREVENTER FAILURE

(75) Inventor: Orlan Lyle, Seabrook, TX (US)

(73) Assignee: Noble Drilling Services Inc., Sugar Land, TX (US)

( * ) Notice: Subject to any disclaimer, the term of this patent is extended or adjusted under 35 U.S.C. 154(b) by 0 days.

(21) Appl. No.: 13/979,932

(22) PCT Filed: Jan. 17, 2012

(86) PCT No.: PCT/US2012/021489

§ 371 (c)(1), (2), (4) Date: Jul. 16, 2013

(87) PCT Pub. No.: WO2012/099841

PCT Pub. Date: Jul. 26, 2012

(65) Prior Publication Data

US 2013/0299177 A1 Nov. 14, 2013

Related U.S. Application Data

(60) Provisional application No. 61/433,757, filed on Jan. 18, 2011.

(51) Int. Cl.
*E21B 43/01* (2006.01)
*E21B 33/064* (2006.01)

(52) U.S. Cl.
CPC ..... *E21B 33/064* (2013.01); *E21B 43/0122* (2013.01)
USPC ..... 166/363; 166/338; 166/351

(58) Field of Classification Search
CPC ..... E21B 33/064; E21B 43/0122
USPC ..... 166/338, 344, 351, 363, 364, 285, 386, 166/85.4, 86.1, 90.1, 96.1, 97.1, 75.13; 137/315.02; 251/1.1–1.3; 414/137.5
See application file for complete search history.

(56) References Cited

U.S. PATENT DOCUMENTS

| | | | | |
|---|---|---|---|---|
| 3,409,084 | A * | 11/1968 | Lawson, Jr. et al. | 166/86.1 |
| 4,149,603 | A | 4/1979 | Arnold | |
| 4,461,354 | A * | 7/1984 | Buras et al. | 166/343 |
| 5,676,209 | A * | 10/1997 | Reynolds | 166/345 |
| 6,474,422 | B2 | 11/2002 | Schubert et al. | |
| 6,499,540 | B2 | 12/2002 | Schubert et al. | |
| 6,554,247 | B2 | 4/2003 | Berckenhoff et al. | |
| 7,134,498 | B2 * | 11/2006 | Hopper | 166/357 |
| 7,549,476 | B2 * | 6/2009 | Carlsen et al. | 166/344 |
| 7,779,917 | B2 * | 8/2010 | Kotrla et al. | 166/345 |
| 7,921,917 | B2 * | 4/2011 | Kotrla et al. | 166/339 |

(Continued)

OTHER PUBLICATIONS

International Search Report from PCT/US2012/021489, issued Jul. 3, 2013.

(Continued)

*Primary Examiner* — Matthew Buck

(57) ABSTRACT

A method for capping a subsea wellbore having a failed blowout preventer proximate the bottom of a body of water includes lowering a replacement blowout preventer system into the water from a vessel on the water surface. The replacement blowout preventer system includes an hydraulic pressure source disposed proximate well closure elements on the replacement blowout preventer system. The replacement blowout preventer system is coupled to the failed blowout preventer. The well closure elements on the replacement blowout preventer system are actuated using the hydraulic pressure source.

6 Claims, 12 Drawing Sheets

(56) References Cited

U.S. PATENT DOCUMENTS

| | | | | |
|---|---|---|---|---|
| 8,136,598 | B2 * | 3/2012 | Kotrla et al. | 166/345 |
| 8,434,557 | B2 * | 5/2013 | Chaddick | 166/344 |
| 8,434,558 | B2 * | 5/2013 | Swanson et al. | 166/368 |
| 8,499,838 | B2 * | 8/2013 | Fraser et al. | 166/338 |
| 8,511,387 | B2 * | 8/2013 | Fraser et al. | 166/350 |
| 8,544,535 | B2 * | 10/2013 | Cote et al. | 166/75.13 |
| 2003/0178200 | A1 * | 9/2003 | Fox et al. | 166/341 |
| 2004/0094305 | A1 * | 5/2004 | Skjærseth et al. | 166/339 |
| 2010/0181075 | A1 | 7/2010 | Reynolds | |
| 2011/0274493 | A1 * | 11/2011 | Cutts | 405/60 |
| 2011/0299930 | A1 * | 12/2011 | Messina | 405/60 |
| 2011/0303416 | A1 * | 12/2011 | Herman, II | 166/350 |
| 2012/0018165 | A1 * | 1/2012 | Crossley et al. | 166/344 |
| 2012/0055573 | A1 * | 3/2012 | Adams | 138/89 |
| 2012/0085543 | A1 * | 4/2012 | Redden et al. | 166/339 |
| 2012/0241160 | A1 * | 9/2012 | Spacek | 166/338 |

OTHER PUBLICATIONS

International Preliminary Report on Patentability from PCT/US2012/021489, issued Jul. 23, 2013.

* cited by examiner

METHOD FOR CAPPING A WELL IN THE EVENT OF SUBSEA BLOWOUT PREVENTER FAILURE

BACKGROUND OF THE INVENTION

1. Field of the Invention

The invention relates generally to the field of drilling wellbores below the bottom of a body of water such as a lake or an ocean. More particularly, the invention relates to methods for stopping uncontrolled flow of fluids from such wells in the event existing fluid flow control devices fail.

2. Background Art

Drilling wellbores into rock formations below the bottom of a body of water from a lake or ocean includes disposing a mobile offshore drilling unit (MODU) above the water surface, typically above the place on the water bottom where the wellbore drilling is started. The MODU deploys equipment to drill a "surface hole", or a portion of the wellbore from the water bottom to a selected depth below the water bottom. Once the depth of the surface hole is reached, a pipe called a "surface casing" is typically inserted and cemented in place. For further drilling of the wellbore to selected formations, e.g., in which hydrocarbons are believed to be present, a device called a "blowout preventer stack" (hereinafter BOP) is typically affixed to a flange or similar connector disposed at the top of the surface casing. See, e.g., U.S. Pat. No. 6,554,247 issued to Berckenhoff et al. for description of an example of a BOP.

The BOP includes one or more "rams" or devices which may be close to form a pressure tight seal, typically by application of hydraulic pressure to actuators for the rams. The rams are provided to hydraulically close the well in the event the well is drilled through formations having fluid pressure therein which exceeds the hydrostatic or hydrodynamic pressure of fluid ("drilling mud") used to drill the wellbore. In such occurrences, it is known in the art that entry of formation fluids into the drilling mud, particularly natural gas, can alter the drilling mud pressure in the wellbore, thus allowing additional fluid to enter the wellbore. The BOP may be operated in such circumstances to prevent uncontrolled discharge of fluid from the formation into the wellbore, while the fluid pressure in the wellbore is adjusted from the MODU. See, e.g., U.S. Pat. No. 6,499,540 issued to Schubert et al. and U.S. Pat. No. 6,474,422 issued to Schubert et al. for an explanation of circumstances leading to the need to operate the BOP and how to safely remove the fluid that has entered the wellbore.

The MODU may be a floating drilling platform (e.g., a semisubmersible platform or drillship) that is not supported from a structure extending to the water bottom. Drilling from a floating drilling platform typically includes installing a pipe from the MODU at the water surface to a connection therefore on the BOP called a "riser." It is also known in the art to drill wellbores below the water bottom without a riser. See, e.g., U.S. Pat. No. 4,149,603 issued to Arnold. It is also known in the art to use water bottom supported MODUs (e.g., "jackup" drilling units) for drilling wellbores below the water bottom.

Irrespective of the type of MODU used or whether the drilling system includes a drilling riser, subsea drilling including the use of a BOP system proximate the water bottom mounted on the surface casing typically includes a plurality of hydraulic pressure accumulators charged to a selected pressure, control valves and other devices so that the BOP system may be operated from controls disposed on the MODU. The controls send electrical and/or hydraulic control signals to the control valves to actuate the various elements of the BOP when needed. See the Berckenhoff '247 patent, for example.

Most government agencies having regulatory authority over drilling operations of the type described above require that the BOP system is tested at certain times to ensure correct operation. Despite these requirements, and despite best efforts of MODU contractor entities to ensure correct operation of BOPs, BOPs have been known to fail. Such failure may be accompanied by catastrophic destruction of property, including total loss of the MODU, injury to persons and loss of life. Further, in such circumstances, including if the MODU is lost, uncontrolled discharge of fluids from the subsurface formations may take place for an extended period of time while equipment to close in or "cap" the well is located and deployed on the wellbore location. Such uncontrolled discharge may lead to substantial environmental damage. Further, methods known in the art for capping a wellbore with a failed BOP require securing another MODU and moving it to the location, with accompanying risk of property damage and risk to human life. Still further, such known methods rely on the use of fluid pumps on remotely operated vehicles (ROVs) to operate hydraulically operated actuators for closing the wellbore to further fluid flow. Because the pumps on a typical ROV have limited flow capacity, it may take an extended amount of time to close the hydraulically operated actuators. Taking such extended time while fluid is discharging from the wellbore risks erosion of the sealing devices, thus making known methods of capping a subsea wellbore subject to inherent failure risk.

What is needed is a method for capping a subsea wellbore having a failed BOP stack that can be operated quickly to reduce risk of seal element failure, and can be deployed from any vessel, thus eliminating the requirement to obtain another MODU in the event of loss of the MODU that drilled the well, or using another MODU to supplement the operation of any MODU still near the wellbore location.

SUMMARY OF THE INVENTION

A method for capping a subsea wellbore having a failed blowout preventer proximate the bottom of a body of water according to one aspect of the invention includes lowering a replacement blowout preventer system into the water from a vessel on the water surface. The replacement blowout preventer includes an hydraulic pressure source disposed proximate well closure elements on the replacement blowout preventer system. The replacement blowout preventer system is coupled to the failed blowout preventer. The well closure elements on the replacement blowout preventer system are actuated using the hydraulic pressure source.

Other aspects and advantages of the invention will be apparent from the following description and the appended claims.

DETAILED DESCRIPTION

Figure 1:
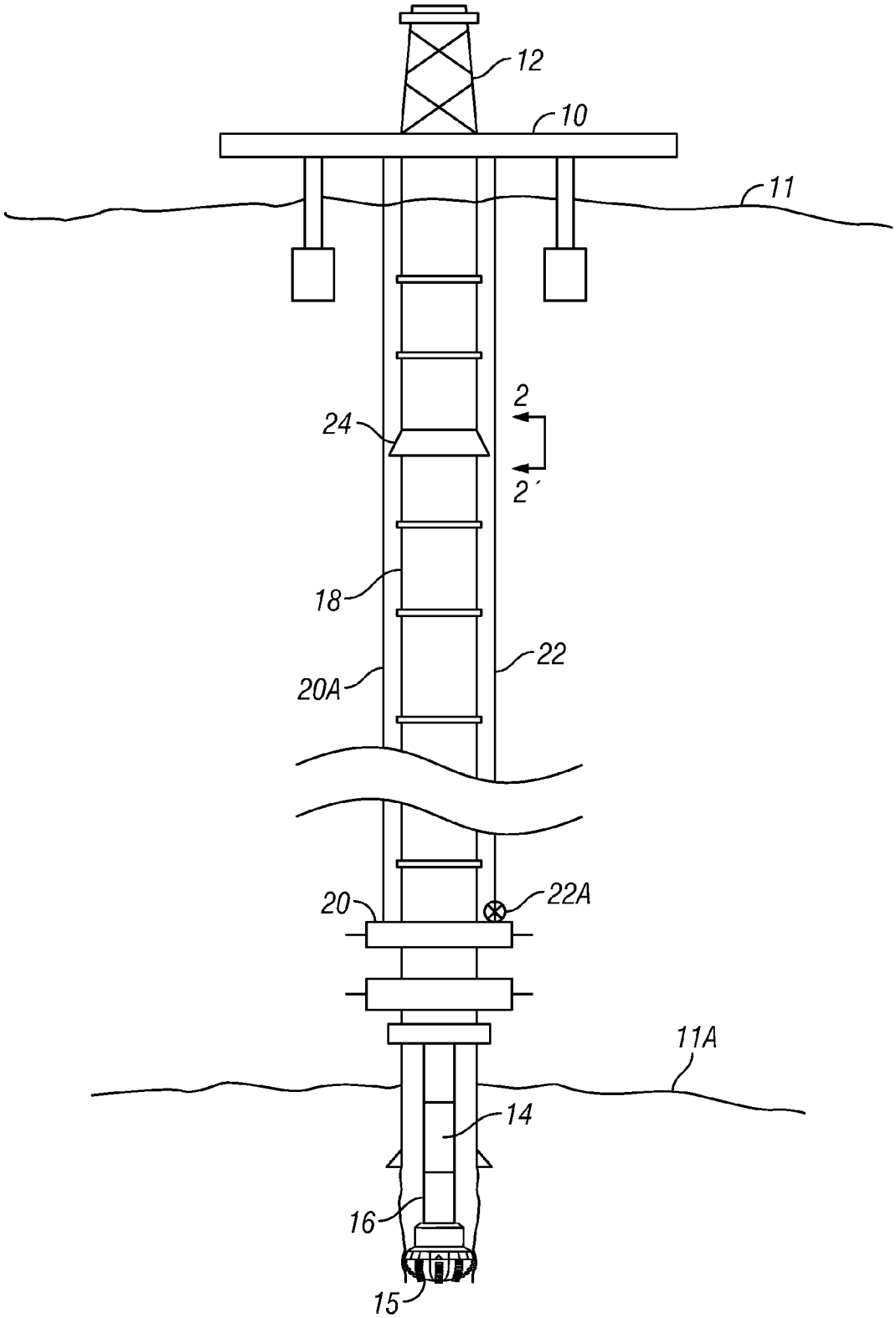
FIG. 1 shows an example floating drilling platform drilling a wellbore below the bottom of a body of water.

Various embodiments of the invention are explained herein in the context of drilling operations from a floating drilling platform. However, it should be clearly understood that methods and systems according to the invention are also applicable to water bottom supported drilling units, and thus, application of the method according to the present invention to drilling from a floating drilling platform is not a limitation on the scope of the present invention. FIG. 1 shows schematically a floating drilling platform 10, such as a semisubmersible drilling rig or a drill ship, on the surface of a body of water 11 such as an ocean as the floating drilling platform 10 is used for drilling a wellbore 16 in formations 17 below the bottom 11A of the body of water 11. The wellbore 16 is typically drilled by a drill string 14 that includes (none of which shown separately) segments of drill pipe that may be threadedly coupled end to end, various stabilizers, drill collars, heavy weight drill pipe, and other tools, all of which may be used to turn a drill bit 15 disposed at the bottom end of the drill string 14. As is known in the art, drilling fluid is pumped down the interior of the drill string 14, exits through the drill bit 15, and is returned to the floating drilling platform 10 for processing. A riser 18 may connect the upper part of the wellbore 16 to the floating drilling platform 10 to form a conduit for return of the drilling fluid to the floating drilling platform 10. Wellbore fluid pressure control equipment, collectively referred to as a blowout preventer (BOP) and shown generally at 20 includes sealing or well closure elements (not shown separately) to hydraulically close the wellbore 16 below the BOP 20 in the event closing the wellbore 16 becomes necessary. The BOP 20 is typically controlled from the floating drilling platform 10 by sending control signals over suitable control lines 20A of types known in the art.

In the present example, the riser 18 may include a booster line 22 coupled near the BOP end thereof or to the BOP 20, selectively opened and closed by a booster line valve 22A. The booster line 22 may form another fluid path from the floating drilling platform 10 to the wellbore 16 at an elevation (depth) proximate the BOP 20. The riser 18 may also include therein a riser disconnect 24 of any type well known in the art, such as may be obtained from Cooper Cameron, Inc., Houston Tex. The riser disconnect 24 may be disposed in the riser 18 at a selected depth below the water surface. The riser disconnect 24 is preferably located at the shallowest depth in the water that is substantially unaffected by action of storms on the water surface. Such depth is presently believed to be about 500 feet. For example, when storm preparations are made, the riser 18 may be uncoupled at the riser disconnect 24, hydraulically sealed, and the upper section of the riser 18 from the riser disconnect 24 to the surface (i.e., at the floating drilling platform 10) may be retrieved onto the floating platform 10, whereupon the floating drilling platform 10 may be moved from the wellbore location for safety.

While the foregoing description of drilling from a floating platform includes the use of a drilling riser, it should be clearly understood that methods according to the present invention are equally applicable with so-called "riserless" subsea drilling systems, in which fluid return from an annular space in the wellbore 16 (located between the drill string 14 and the wall of the wellbore 16) is returned to the floating drilling platform 10 by a separate fluid line (not shown). In such systems, a rotating control head (RCH), rotating diverter or similar device may be affixed to the top of the BOP 20 to prevent discharge of fluid from the annular space into the water, and to divert the flow of drilling fluid from the annular space entirely into the return line (not shown). Such systems are also known in the art to include mud lift pumps (not shown) to lower the fluid pressure in the annular space below that of the hydrostatic pressure resulting from the vertical extent (height) of the drilling mud in the annular space and return line to the platform 10. Using such riserless drilling fluid return systems is also within the scope of the present invention. See, e.g., U.S. Pat. No. 4,149,603 issued to Arnold.

Figure 2:
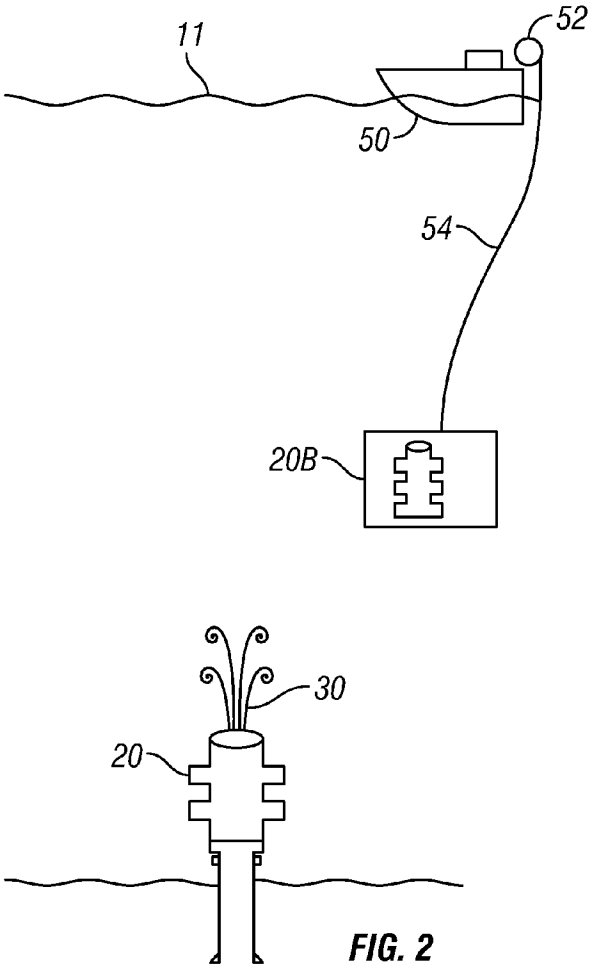
FIG. 2 shows lowering a replacement BOP onto the failed BOP using a winch from a vessel on the water surface.

FIG. 2 shows that the BOP 20 has failed, and is allowing uncontrolled discharge of fluid 30 from within the wellbore (16 in FIG. 1) into the water 11. Failure in the present context includes, by way of example and without limitation, failure of actuators (not shown) on the BOP 20 to operate so as to close wellbore closure devices ("rams", not shown separately) inside the BOP 20, and failure of sealing elements (not shown separately) on the rams (not shown) to cause a fluid tight seal of the wellbore (16 in FIG. 1) when the actuators are operated.

A vessel 50 on the water 11 surface may lower a replacement BOP system 20B into the water 11 by extending a cable 54 from a winch 52. In the present example, the floating drilling platform (10 in FIG. 1) and the riser (18 in FIG. 1) are shown as absent. For purposes of defining the scope of the invention, however, the floating drilling platform (10 in FIG. 1) may also be used to lower the replacement BOP system 20B by a winch or any other device thereon, if the floating drilling platform (10 in FIG. 1) is still located proximate the wellbore geodetic location. In the event of loss of the floating drilling platform (10 in FIG. 1) or its being moved away from the wellbore geodetic location for safety reasons (e.g., without limitation, natural gas being discharged into the water thereby reducing its buoyancy), the vessel 50 may be any type of vessel, including those that do not have equipment onboard to drill a wellbore, as is present on a drilling platform (such as shown in FIG. 1).

Figure 3:
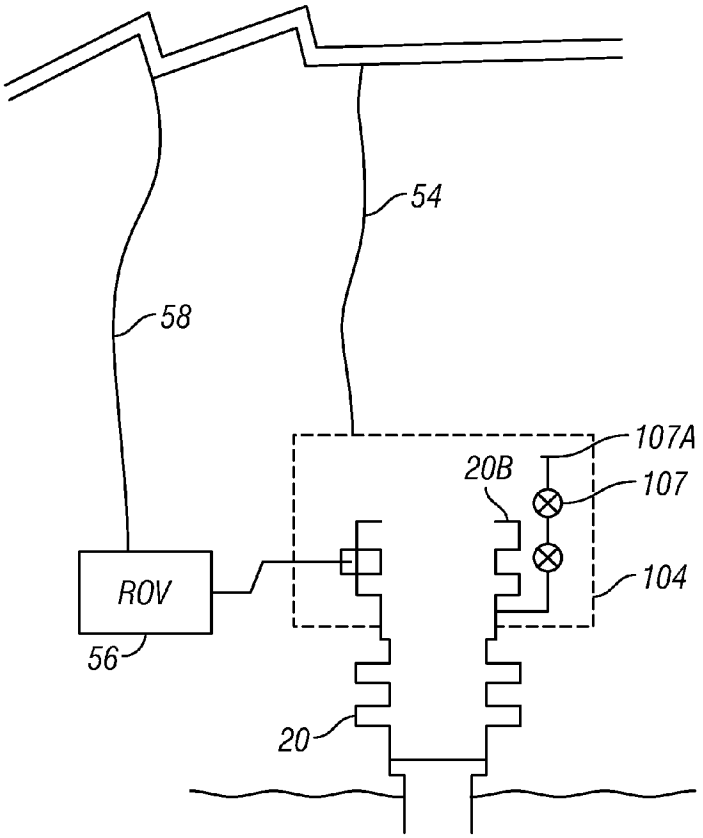
FIG. 3 shows coupling the replacement BOP to the failed BOP using a ROV.

When the replacement BOP system 20B is extended to the depth in the water of the top of the failed BOP 20, and referring to FIG. 3, a remotely operated vehicle (ROV) 56 may be operated in the water and supplied with power and control signals from a deployment vessel (e.g., 50 in FIG. 2) on the water surface (not shown in FIG. 3) typically through an umbilical line 58. The ROV 56 may be used to couple the replacement BOP system 20B to the top of the failed BOP 20. The replacement BOP system 20B may be contained in a frame or skid 104 (explained below in more detail with reference to FIG. 4) and may include an hydraulic line 107A that may be closed to fluid flow using one or more control valves 107. The control valve(s) 107 may be opened at a later time, whereupon it is then possible to make fluid connection into the wellbore at a position below the replacement BOP system 20B, so that fluids may be pumped into the wellbore (16 in FIG. 1) after the wellbore has been closed to flow therefrom by operating rams (not shown separately) in the replacement BOP system 20B.

Figure 4A:
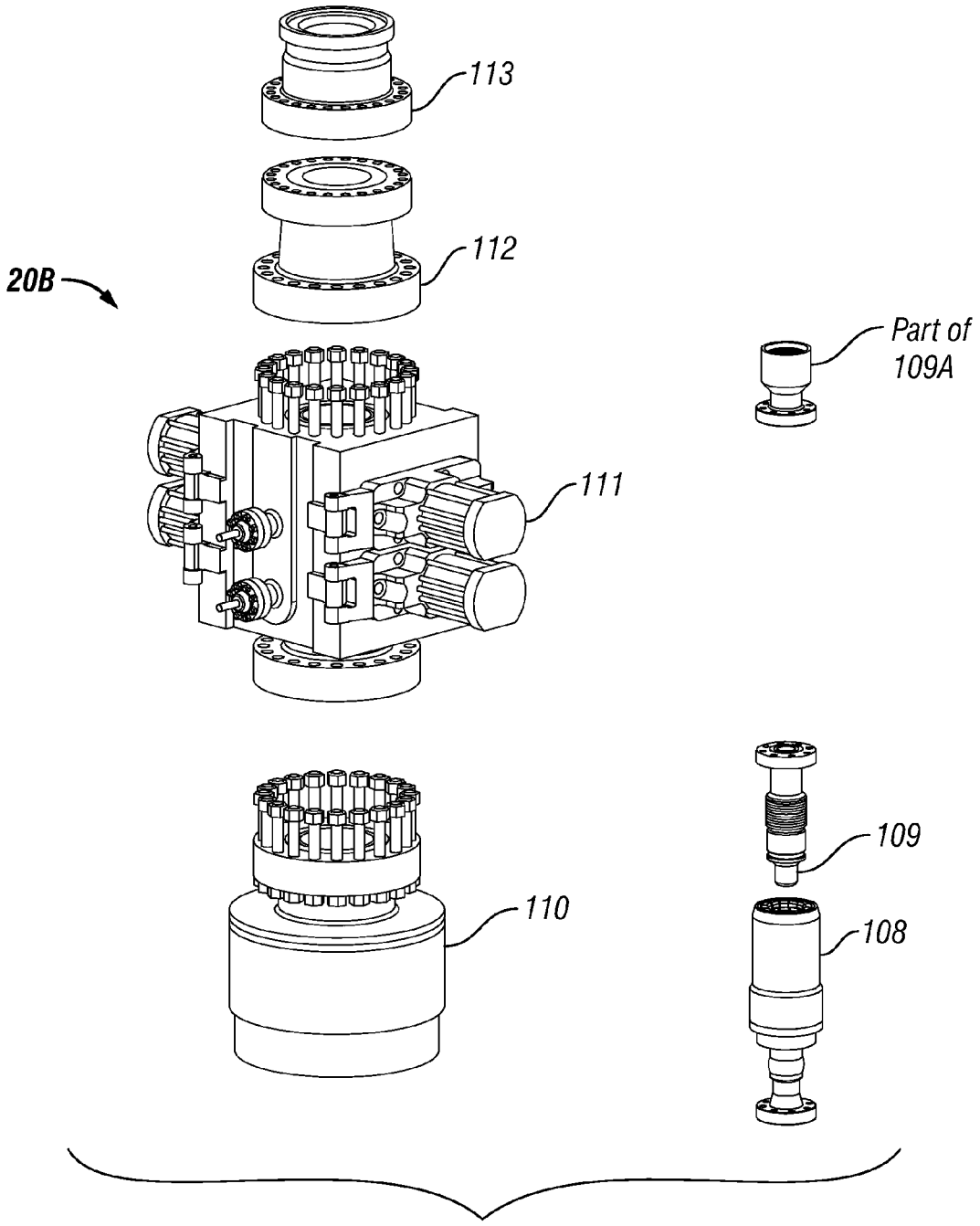
FIGS. 4A through 4D show an exploded view of the replacement BOP.
Figure 4B:
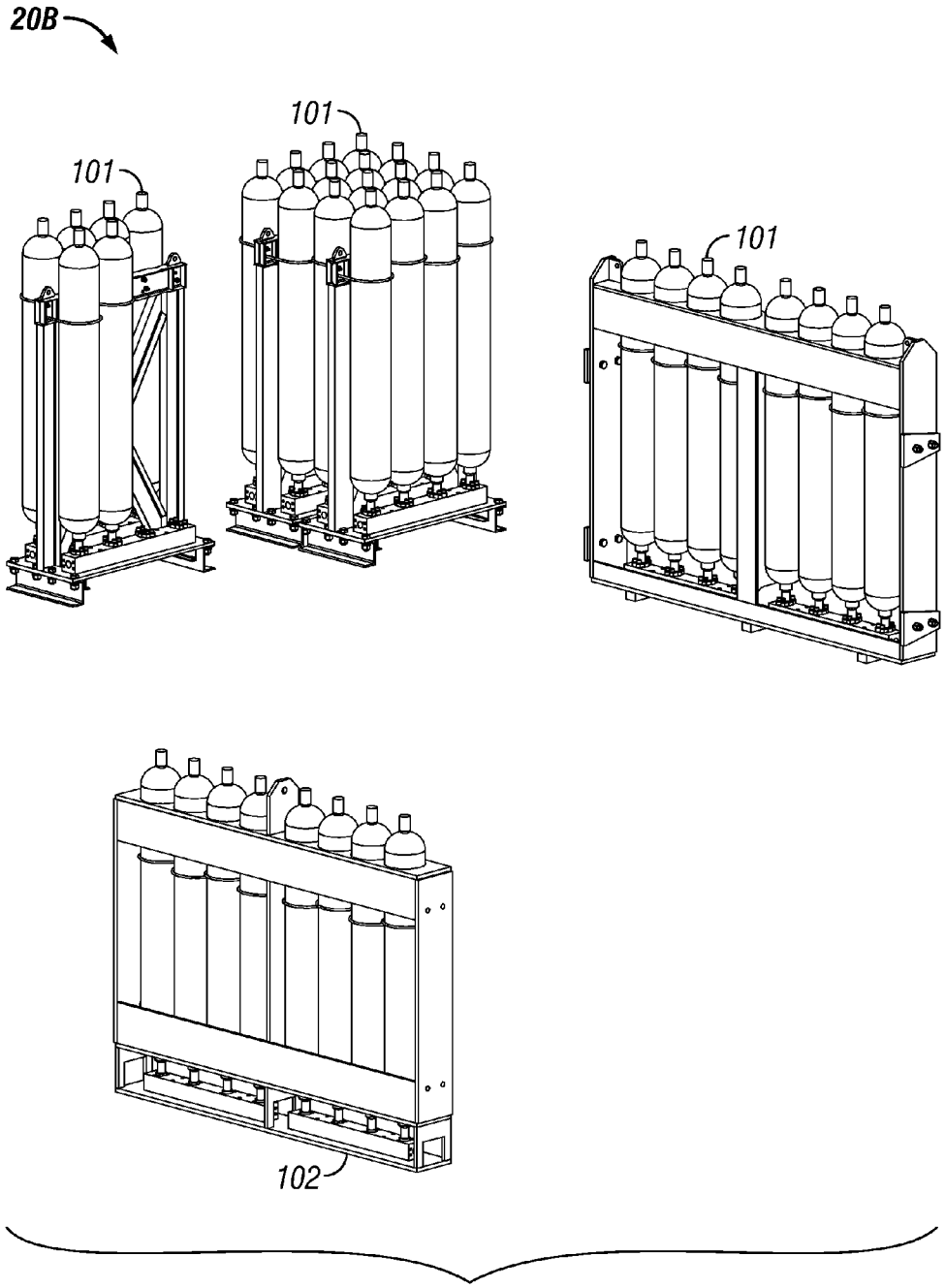

An example of a replacement BOP system is shown in exploded view in FIGS. 4A through 4D. The principal components of the replacement BOP system 20B may be mounted to or otherwise associated with the frame or skid 104 (FIG. 4C) mentioned above. Referring to FIG. 4B, generally, the replacement BOP system 20 includes most of the components of a typical subsea BOP system, including pressure accumulators 101, 102, and an hydraulically operated pressure control (not shown separately). FIG. 4A shows a well closure device or ram assembly 111, a crossover coupling 112 on an upper side of the ram assembly 111, and an upper connector 113 to enable latching a lower marine riser package (LMRP) to the replacement BOP system 20B if desired. Connections for fluid to be pumped below the ram assembly 111 are shown as couplings part of 109A (hose shown in FIG. 9), 109 and 108.

The pressure accumulators 101, 102 (FIG. 4B) are typically precharged to a selected pressure, and may be pressure compensated for the hydrostatic pressure of the water at the depth of the water bottom, so that operating pressure for the replacement BOP system 20B may be available without the need for fluid pumps, as will be further explained below.

Still referring to FIG. 4A, the bottom of the closure device or ram assembly 111 may include a coupling 110 to enable latching the closure device or ram assembly 111 to a similar coupling (not shown) on the failed BOP (20 in FIG. 2). The coupling 110 may be performed in a manner similar to coupling a LMRP (not shown) to the BOP (20 in FIG. 2).

Figure 4C:
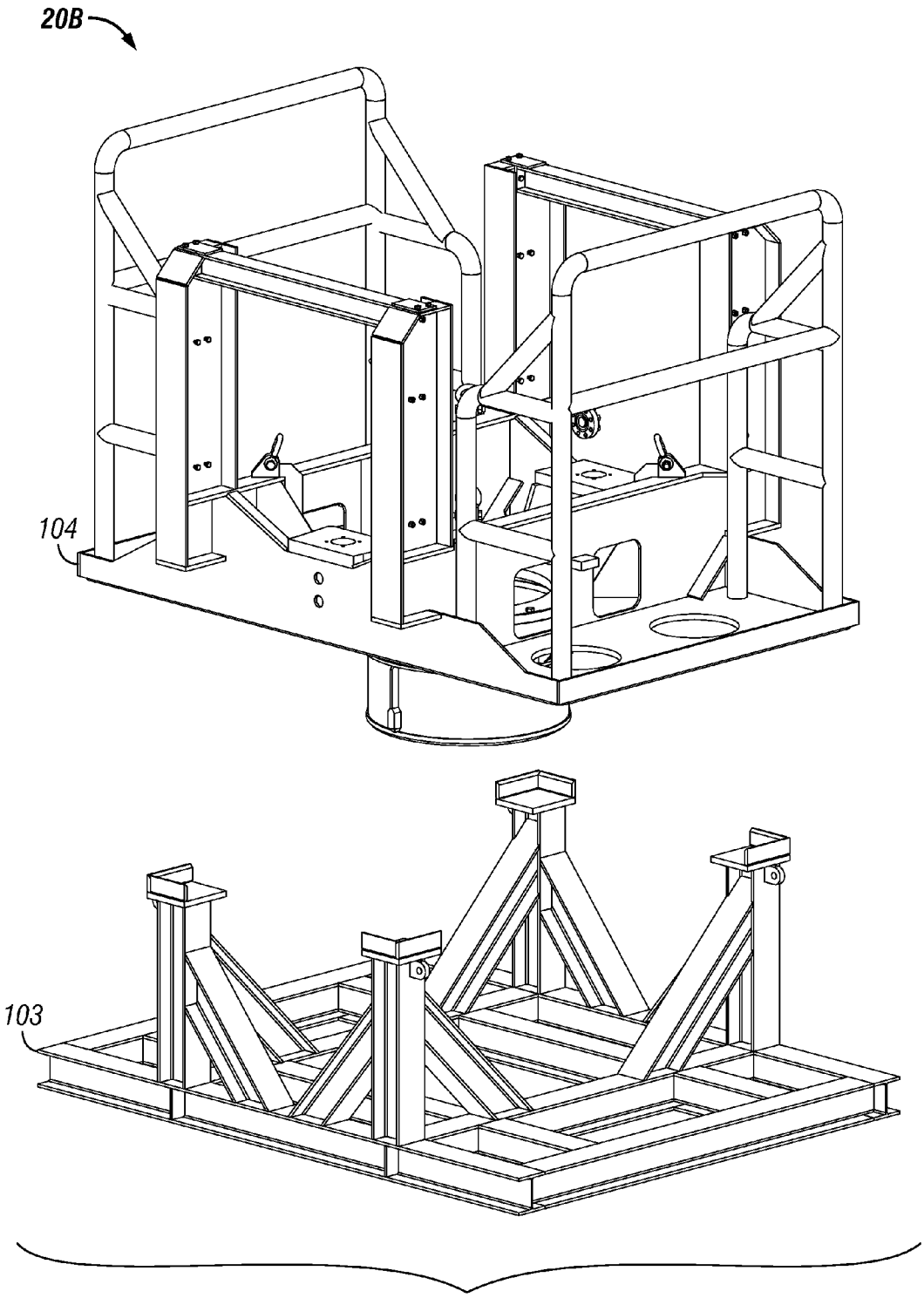
Figure 4D:
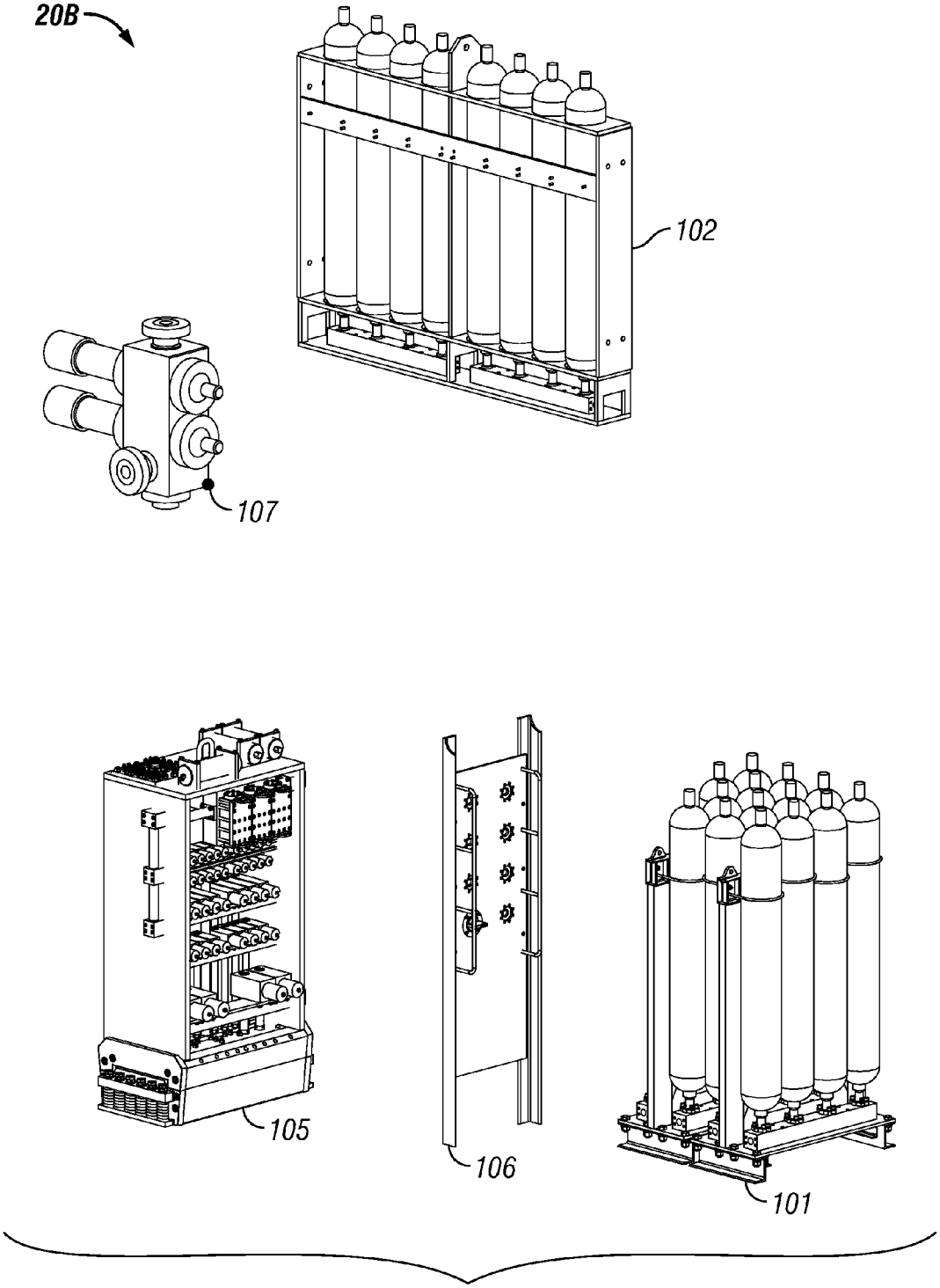

The replacement BOP system 20B as shown in FIG. 4D may include a conventional ROV operating control panel 105 and an interface panel 106 for operating valves (not shown separately) to actuate the closure device or ram assembly 111 to stop flow of fluid from the wellbore. Such valves (not shown separately) may be hydraulically connected between the actuators on the closure device or ram assembly 111 (FIG. 4A) and output of pressure regulator(s) (not shown) coupled to the pressure output of the accumulators 101, 102 (FIG. 4B). Also shown in FIG. 4D is a gate valve assembly 107 coupled to the collet type fluid line connector 108 (FIG. 4A). The fluid line connector 108 (FIG. 4A) may be coupled to a drill pipe crossover sub 109 (FIG. 4A—explained further below). The gate valve assembly 107 may control flow through the line (107A in FIG. 3) to enable pumping of fluid (or controlled release of fluid) to a point below the replacement BOP system 20B when actuated. Non limiting examples of actuators for the closure device assembly and typical closure devices are described in U.S. Pat. No. 6,554,247 issued to Berckenhoff et al., incorporated herein by reference.

All of the foregoing components of the replacement BOP system 20B may be preassembled away from the wellbore location and moved from the preassembly location to the wellbore location using a shipping frame 103 (FIG. 4C) disposed under the assembled replacement BOP system 20B including the skid 104 (FIG. 4C). The replacement BOP system 20B does not require any form of control signal connection to the surface (e.g., to controls on the floating drilling platform) as would ordinarily be used in a water-bottom BOP system during drilling. In the present example, the ROV (56 in FIG. 3) may be used to operate valve controls on the interface panel 106 (FIG. 4C). Such capability enables the replacement BOP system 20B to be operated (i.e., to hydraulically close the wellbore) without the need to make direct connection to a MODU or surface vessel (floating or bottom supported drilling platform), or even to have a MODU present near the wellbore location at the time the wellbore is closed to flow.

Figure 5:
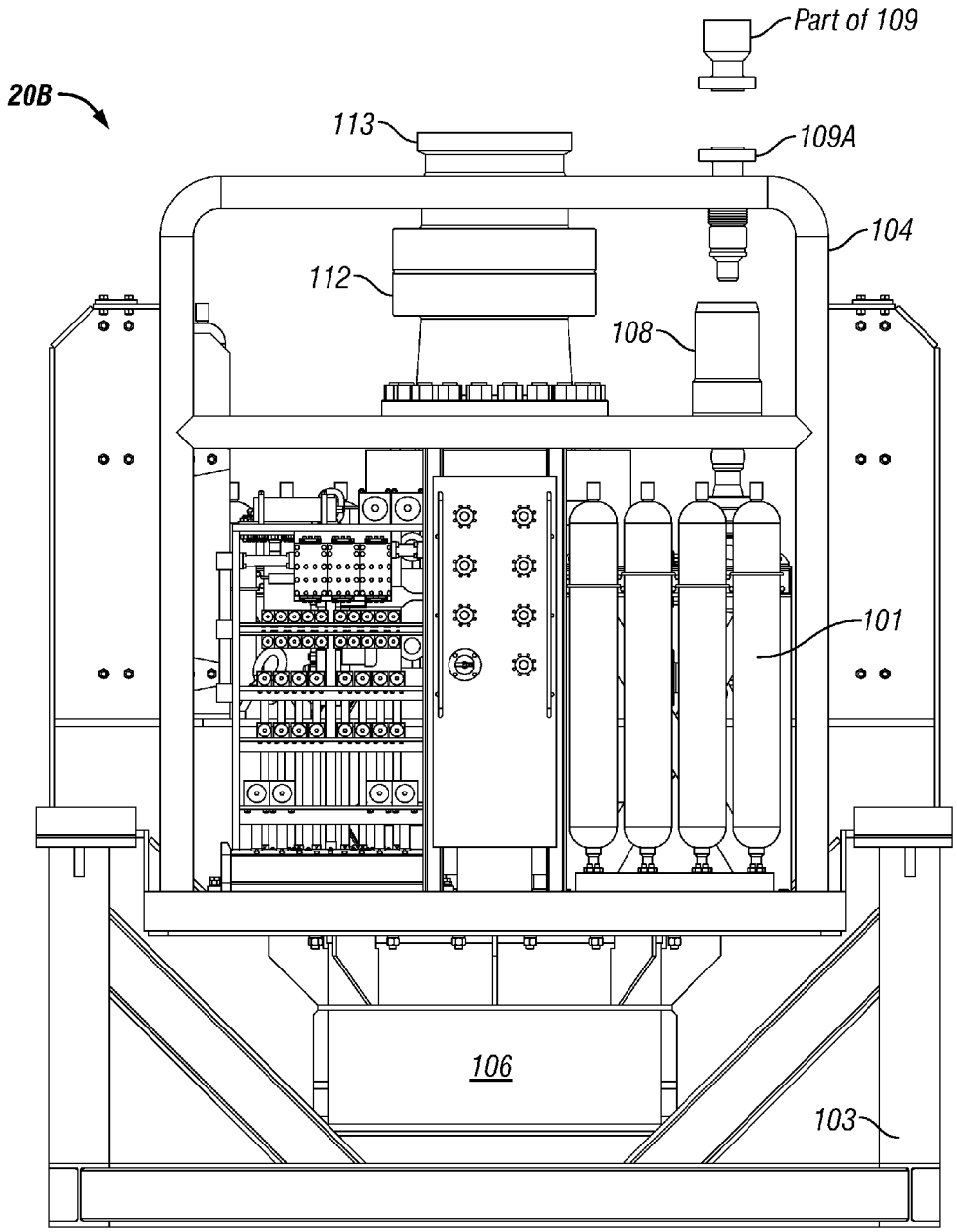
FIGS. 5 through 8 show various views of the replacement BOP.
Figure 6:
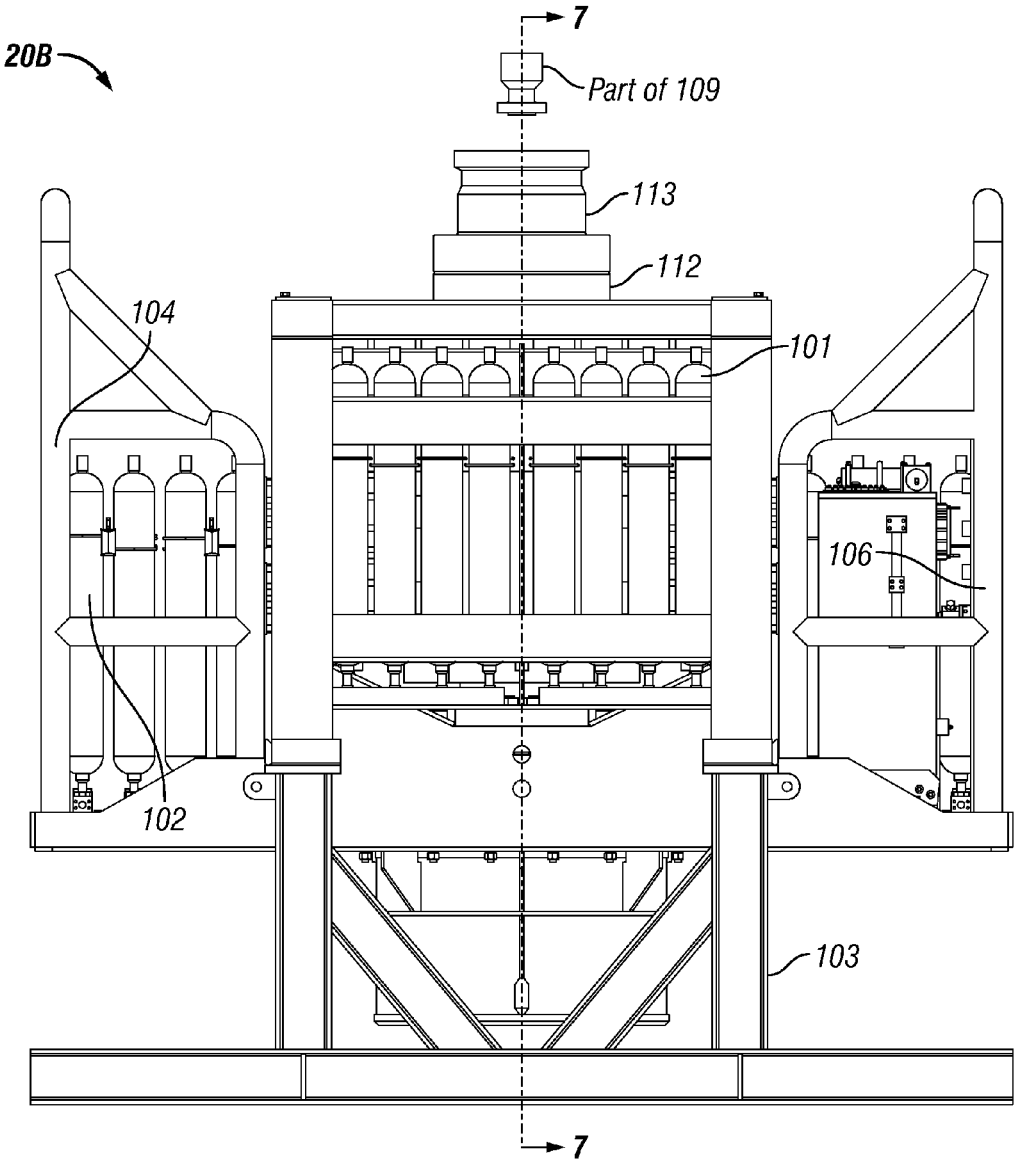
Figure 7:
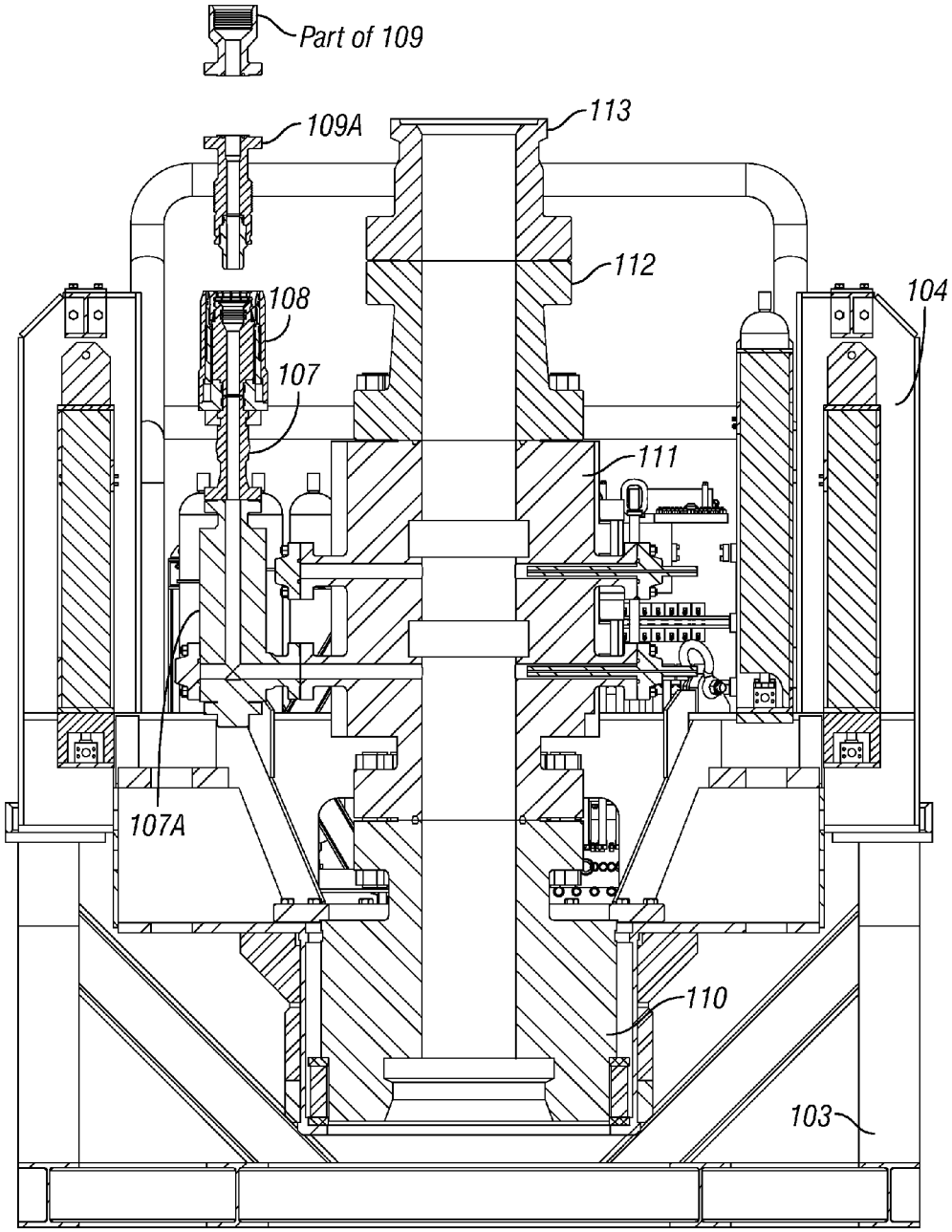
Figure 8:
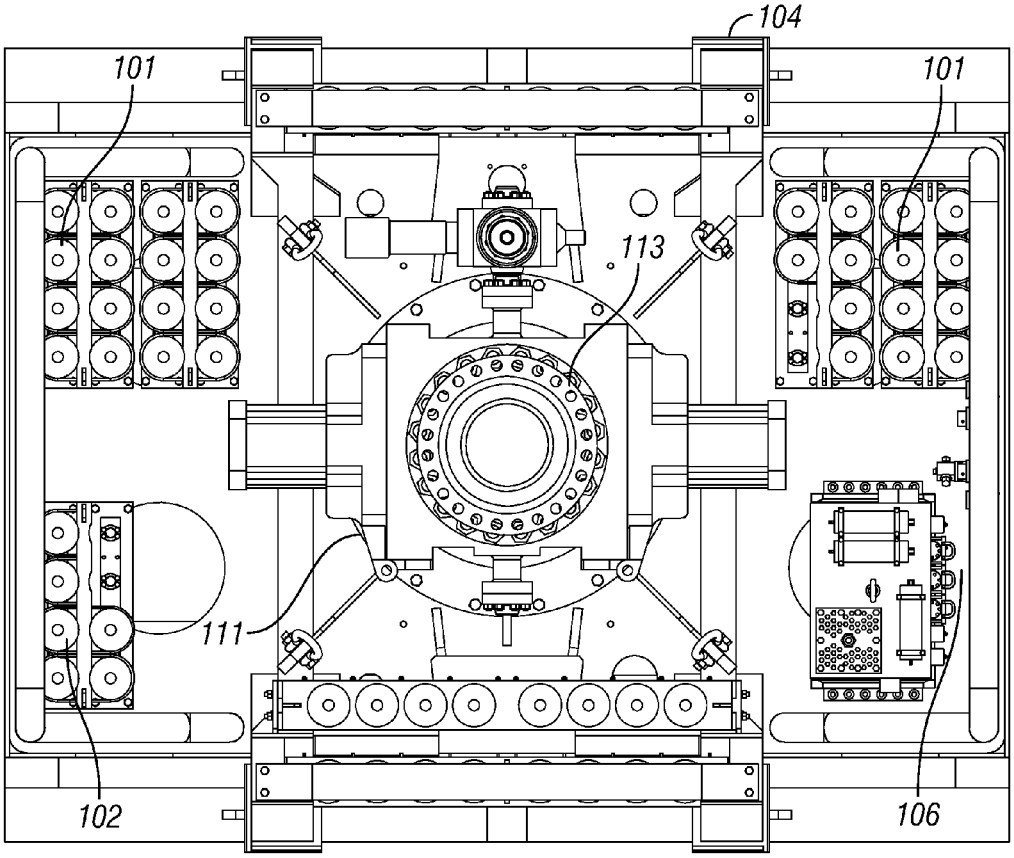

FIGS. 5, and 6 show, respectively, side and end views of the replacement BOP system 20B. FIG. 7 shows a cross section of the replacement BOP system 20B, in which the fluid line 107A can be observed. FIG. 8 shows a top view of the replacement BOP system 20B.

Figure 9:
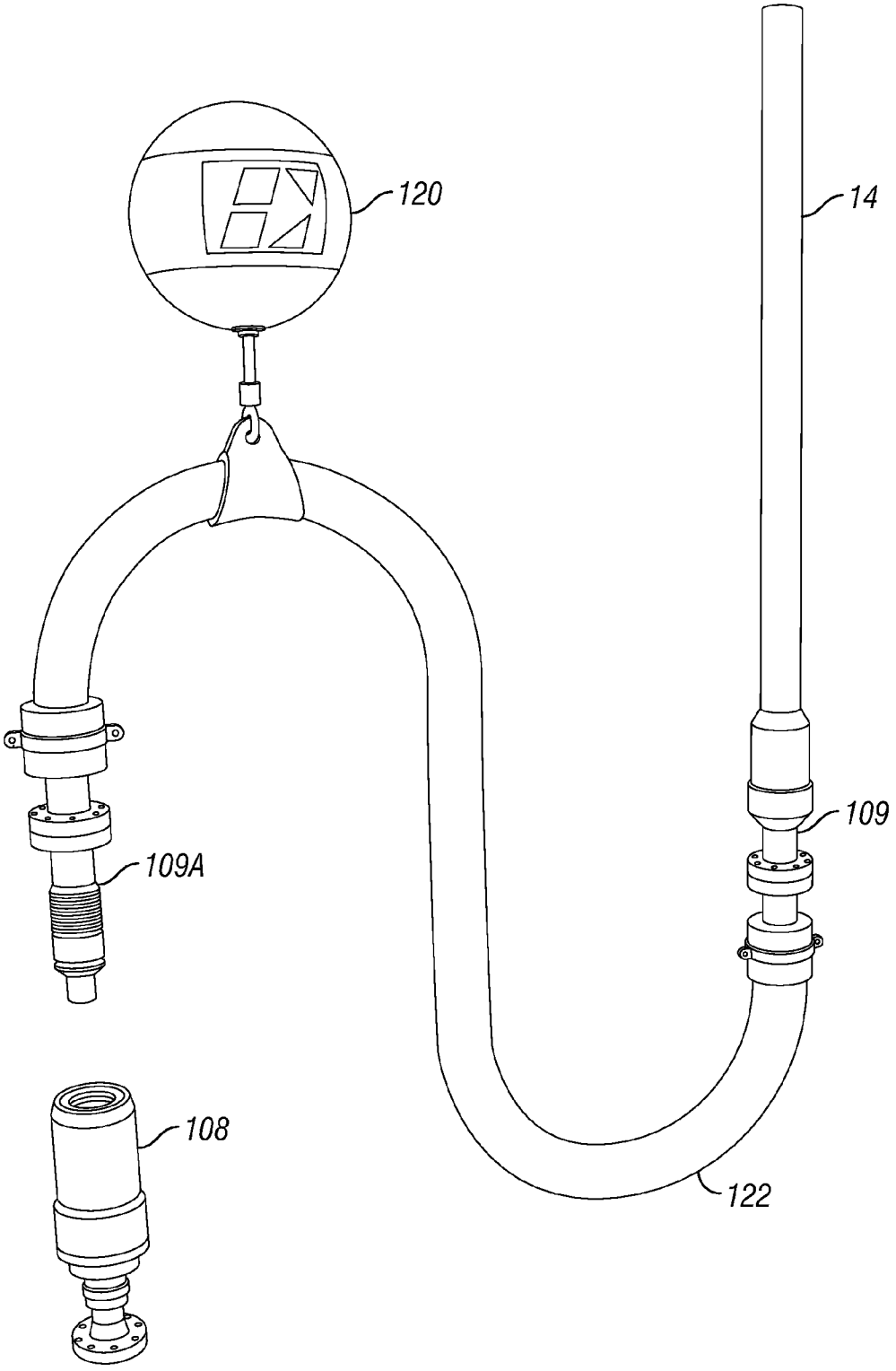
FIG. 9 shows an example fluid connection to a drill pipe to pump fluid into the wellbore below the replacement BOP.

FIG. 9 shows components that may be used to assist pumping fluid into the fluid line (107A in FIG. 3) to further provide fluid pressure control of the wellbore, or to pump in sealing material such as cement to permanently close the wellbore for its safe abandonment. The components include a crossover coupling 109, which may be threaded at one end to the lower end of a drill string (e.g., 14 in FIG. 1) when the platform (10 in FIG. 1) returns to the wellbore location or another MODU is secured and moved over the wellbore location. The crossover coupling 109 may be coupled at its other end to a hose 122. The hose 122 may be buoyantly supported by a float 120 in a position such as the one shown in FIG. 9 to provide a fluid trap shape to the hose (S-shaped as shown), but still leaving enough negative buoyancy to the complete assembly of the hose 122 and connectors (109 and corresponding connector 109A at the other end thereof) so that another connector 109A may be latched into a collet type locking connector 108 disposed at the top of the fluid line (107A in FIG. 3). Making the latter connection and operation of the control valves (106 in FIG. 4) and fluid line valves (107A in FIG. 3) may be performed by an ROV, such as the one shown in FIG. 3 at 56.

Figure 10:
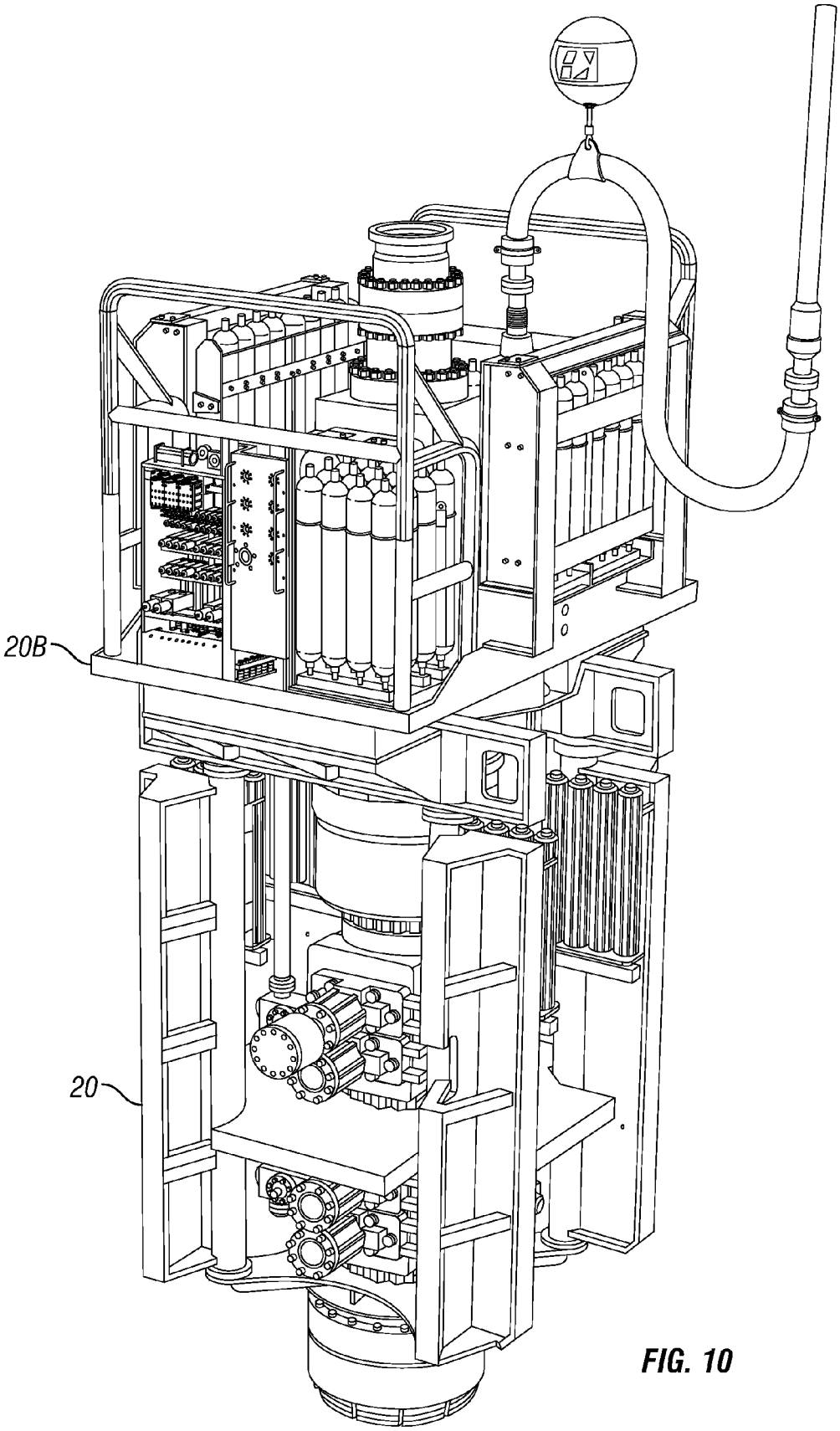
FIG. 10 shows the replacement BOP assembled to the failed BOP, including the fluid line shown in FIG. 9.

FIG. 10 shows the replacement BOP system 20B coupled to the top of the failed BOP as explained above. The replacement BOP system 20B can provide effective control of fluid flow from the wellbore, with reduced risk of closure element seal failure. The foregoing benefit may be obtained as a result of relatively fast operation of the closure element actuators using the hydraulic pressure stored in the associated accumulators. Thus, the probability of safely sealing the wellbore is increased as compared to using methods known prior to the present invention.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method for capping a subsea wellbore having a failed blowout preventer proximate the bottom of a body of water, comprising:

lowering a replacement blowout preventer system into the water from a vessel on the water surface, the replacement blowout preventer system including an hydraulic pressure source comprising at least one accumulator precharged to a selected operating pressure compensated for hydrostatic pressure disposed proximate well closure elements on the replacement blowout preventer system;

coupling the replacement blowout preventer system to the failed blowout preventer; and operating the well closure elements on the replacement blowout preventer system by using a remotely operated vessel to operate valve controls proximate the well closure elements to conduct pressure from the at least one accumulator of the hydraulic pressure source to actuators for the well closure elements.

2. The method of claim 1 wherein the hydraulic pressure source comprises accumulators disposed on a skid coupled to the replacement blowout preventer system.

3. The method of claim 1 wherein the lowering comprises extending a cable from a winch disposed on the vessel.

4. The method of claim 1 wherein the vessel excludes equipment for drilling a wellbore.

5. The method of claim 1 further comprising moving a mobile offshore drilling unit or another vessel on the water surface proximate a geodetic location of the wellbore, coupling a pump to an hydraulic line in fluid communication with the wellbore below the replacement blowout preventer system, opening a valve to make hydraulic communication between the hydraulic line and the pump, and pumping sealing material into the wellbore below the replacement blowout preventer.

6. The method of claim 5 wherein the sealing material comprises cement.

* * * * *